US006640400B1

(12) United States Patent
Chen

(10) Patent No.: US 6,640,400 B1
(45) Date of Patent: Nov. 4, 2003

(54) EXTERNAL STRAP BUCKLING ASSEMBLY OF LUGGAGE

(76) Inventor: Shou Mao Chen, 344, Section 1, Chung Shan Road, Ta-Cha Township, Taichung Hsien (TW)

( * ) Notice: Subject to any disclaimer, the term of this patent is extended or adjusted under 35 U.S.C. 154(b) by 0 days.

(21) Appl. No.: 10/285,813

(22) Filed: Nov. 4, 2002

(51) Int. Cl.[7] ..... A44B 11/25; A44B 21/00

(52) U.S. Cl. ..... 24/651; 24/662; 24/664; 24/700; 24/701; 190/18 A

(58) Field of Search ..... 24/651, 662, 664, 24/666, 701, 700, 702, 198, 599.9; 190/18 A; 280/655.1

(56) References Cited

U.S. PATENT DOCUMENTS 2,346,887 A * 4/1944 Winkler ..... 24/651
2,882,581 A * 4/1959 Spielman ..... 24/644
5,329,677 A * 7/1994 Kanzaka ..... 24/687
5,431,262 A * 7/1995 Rekuc et al. ..... 190/18
6,141,841 A * 11/2000 Workman ..... 24/701
6,216,322 B1 * 4/2001 Kuo ..... 24/599.9
6,412,153 B1 * 7/2002 Khachadourian et al. ..... 24/614

* cited by examiner

*Primary Examiner*—Victor Sakran
(74) *Attorney, Agent, or Firm*—Harrison & Egbert

(57) ABSTRACT

A strap buckling assembly is used for holding an attachment to the exterior of luggage and is formed of an outer housing, an inner housing, an urging block, a locating plate, an elastic body, and a male retainer. The outer housing is fastened to the external side of a shell of the luggage, while the inner housing is fastened to the internal side of the shell of the luggage. The urging block is movably located in the outer housing and is urged by the elastic body. The urging block serves to retain an engagement portion of the male retainer inside the outer housing in conjunction with the elastic body. The urging block also serves to release the engagement portion of the male retainer from the outer housing in conjunction with the elastic body. The male retainer is fastened at one end to the strap.

3 Claims, 7 Drawing Sheets

EXTERNAL STRAP BUCKLING ASSEMBLY OF LUGGAGE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to luggage, and more particularly to an external strap buckling assembly for luggage, by which an attachment is held to the exterior of a piece of luggage.

The present invention relates generally to a luggage, and more particularly to an external strap buckling assembly of the luggage, by which an attachment is held to the exterior of the luggage.

BACKGROUND OF THE INVENTION

As illustrated in FIG. 9, a prior art luggage 92 is provided with a buckling device 90 which is mounted fixedly on the external surface of the luggage 92 by means of a strap 91. The buckling device 90 is used to hold-an attachment to the exterior of the luggage 92.

The buckling device 90 is apt to make noise or sway. In addition, the buckling device 90 undermines the overall esthetic effect of the luggage 92. Moreover, the buckling device 90 is susceptible to damage by impact, especially at the time when the luggage 92 is handled for transportation.

BRIEF SUMMARY OF THE INVENTION

The primary objective of the present invention is to provide a luggage with an external strap buckling assembly which is free of the deficiencies of the prior art device described above.

In keeping with the principle of the present invention, the foregoing objective of the present invention is attained by a buckling assembly comprising an outer housing, an inner housing, an urging block, an elastic body, a locating plate, and a male retainer fastened with an external strap. The urging block, the elastic body, and the locating plate are disposed between the outer housing and the inner housing. The outer housing is fastened with the external side of a luggage shell, while the inner housing is fastened with the internal side of the luggage shell. The male retainer is provided with an L-shaped engagement portion and a projection extending from the engagement portion. The engagement portion and the projection are removably retained in the interior of the outer housing such that the engagement portion and the projection are pressed against by the urging block which is in turn urged by the elastic body.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
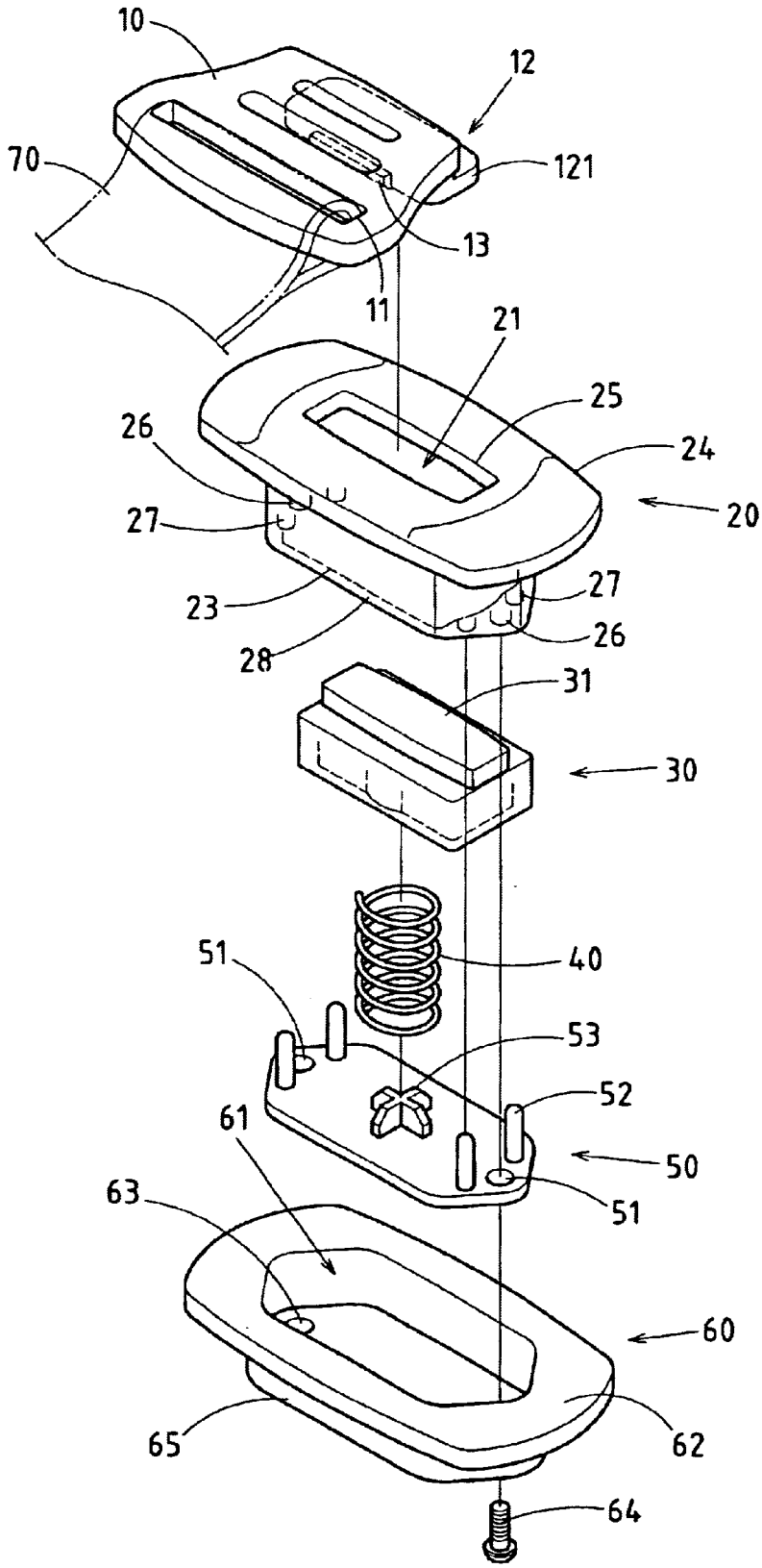
FIG. 1 shows an exploded perspective view of the preferred embodiment of the present invention.

As shown in FIGS. 1–8, an external strap buckling assembly embodied in the present invention comprises an outer housing 20, an inner housing 60, an urging block 30, an elastic body 40, a locating plate 50, and a male retainer 10 by which a strap 70 is detachably fastened to the exterior of a luggage 80 for the purpose of holding an attachment to the luggage 80.

The outer housing 20 is fastened with the external side of a shell 81 of the luggage 80 and is provided in the interior with a cell 21. The outer housing 20 is further provided in a top 24 with a through slot 25 in communication with the cell 21, and in a bottom 28 with an opening 23 and a plurality of threaded holes 26 engageable with screws 64.

The inner housing 60 is provided with an open slot 61 and a top 62 corresponding in size and shape to the top 24 of the outer housing 20. The inner housing 60 is further provided in a bottom 65 with a plurality of through holes 63 corresponding in location to the threaded holes 26 of the outer housing 20.

The locating plate 50 is provided with a plurality of through holes 51 corresponding in location to the through holes 63 of the inner housing 60 and the threaded holes 26 of the outer housing 20. The locating plate 50 is disposed in the open slot 61 of the inner housing 60.

The urging block 30 is provided in the upper side with a protrusion 31 corresponding to the through slot 25 of the outer housing 20. The urging block 30 is movably disposed in the opening 23 of the bottom 28 of the outer housing 20.

The elastic body 40 is disposed between the urging block 30 and the locating plate 50 such that one end of the elastic body 40 urges the underside of the urging block 30, and such that the other end of the elastic body 40 is located on the locating plate 50.

The outer housing 20 and the inner housing 60 are fastened together by a plurality of screws 64, which are engaged with the threaded holes 26 of the outer housing 20 via the through holes 63 of the inner housing 60 and the through holes 51 of the locating plate 50. The outer housing 20 is fastened to the external side of the shell 81 of the luggage 80, while the inner housing 60 is fastened to the internal side of the shell 81 of the luggage 80, as shown in FIGS. 2–6.

Figure 2:
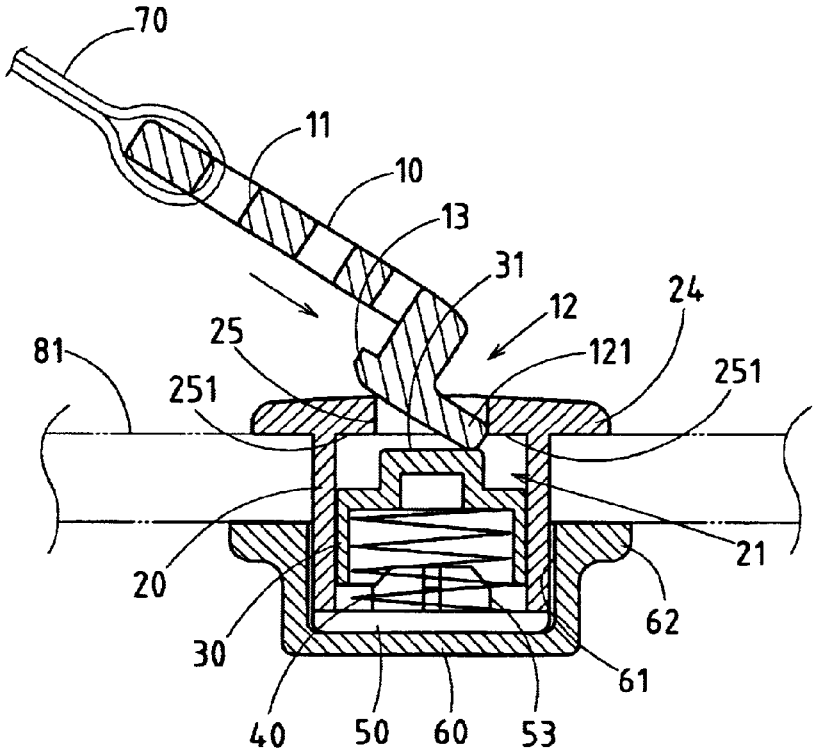
FIGS. 2 and 3 are sectional schematic views to show the steps by which the male retainer is engaged with the outer housing of the preferred embodiment of the present invention.
Figure 3:
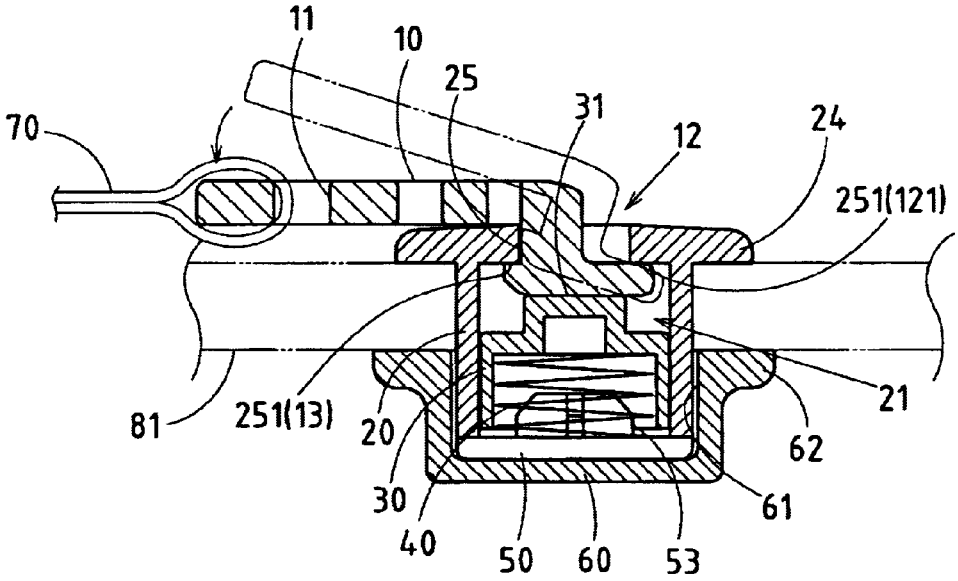
Figure 4:
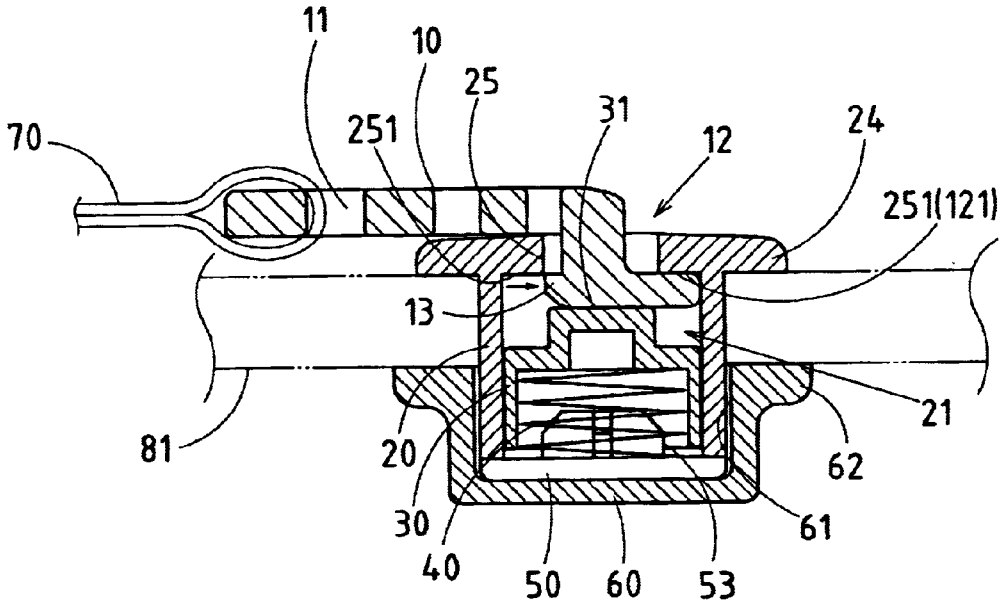
FIGS. 4–6 are sectional schematic views to show the steps by which the male retainer is disengaged with the outer housing of the preferred embodiment of the present invention.

The male retainer 10 is fastened at one end 11 with the strap 70 and is provided at other end with an engagement portion 12 of an L-shaped construction. The engagement portion 12 is provided with a projection 13 extending from the engagement portion 12. In operation, the engagement portion 12 and the projection 13 are put into the cell 21 of the outer housing 20 via the through slot 25 of the outer housing 20 such that the engagement portion 12 and the projection 13 press against the protrusion 31 of the urging block 30, thereby resulting in compression of the elastic body 40, as shown in FIGS. 2 and 3. As the engagement portion 12 is relieved of the pressure exerting thereon, the engagement portion 12 is caused by the spring force of the elastic body 40 to moved upward, thereby causing one arm 121 of the L-shaped engagement portion 12 and the projection 13 to be stopped by two arresting portions 251 of the through slot 25. The arresting portions 251 are in fact the walls which are contiguous to the inner end edge of the through slot 25. It must be noted here that the projection 13 is aligned with the one arm 121 of the L-shaped engagement portion 12. The engagement portion 12 is held securely in place in the cell 21 such that the arm 121 and the projection 13 are held securely between the arresting portions 251 and the protrusion 31 of the urging block 30.

Figure 5:
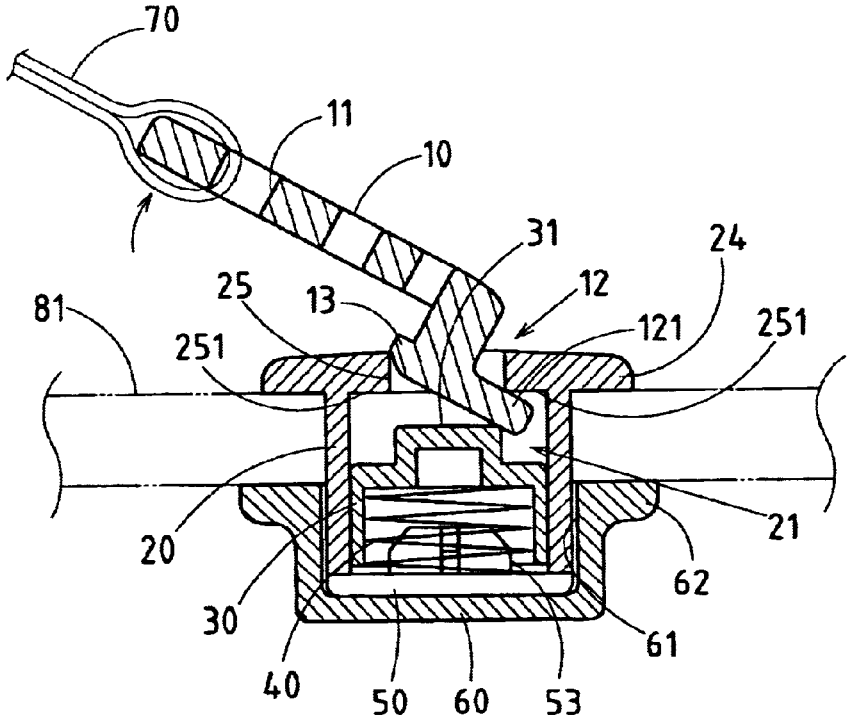
Figure 6:
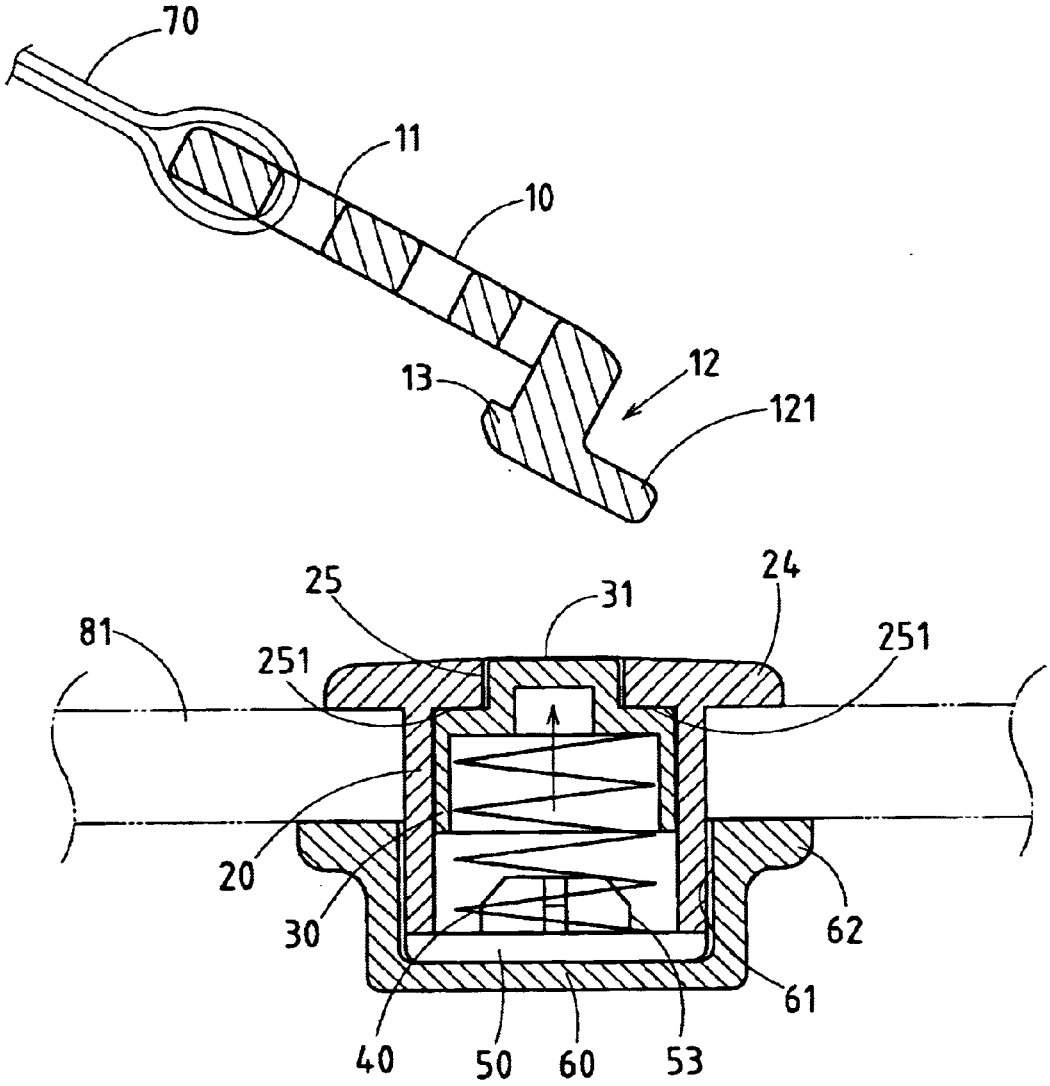
Figure 7:
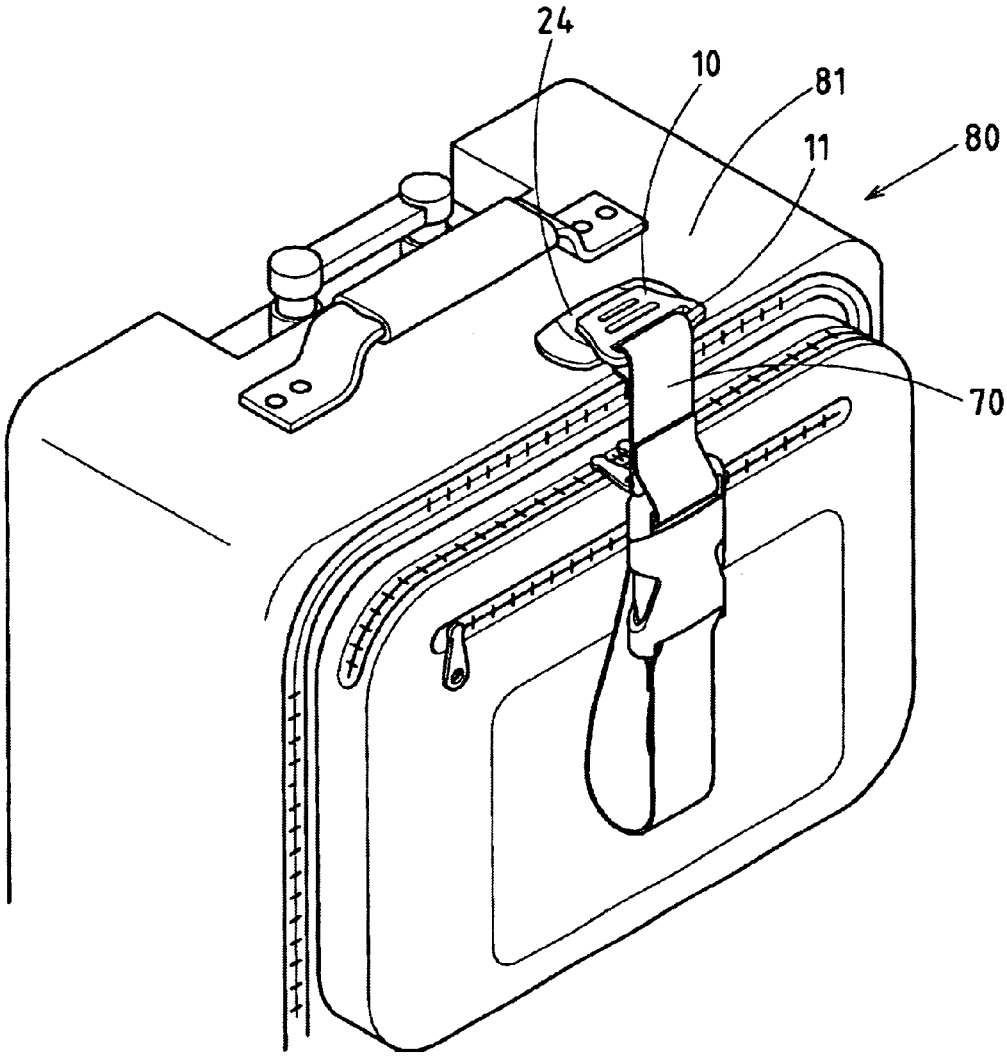
FIG. 7 shows a perspective view of a luggage of the preferred embodiment of the present invention, with the external strap being fastened to the luggage.

The male retainer 10 can be disengaged with the outer housing 20 by exerting pressure on the engagement portion 12 so as to cause the urging block 30 to move downward to press against the elastic body 40, thereby enabling the projection 13 to be first moved out of the cell 21 via the through slot 25, as shown in FIG. 5. The arm 121 of the engagement portion 12 is then pulled out of the cell 21 via the through slot 25. In the meantime, the urging block 30 is forced by the spring force of the elastic body 40 to move back up such that the protrusion 31 of the urging block 30 is fitted into the through slot 25 of the outer housing 20, as shown in FIG. 6. The through slot 25 is thus sealed off by the protrusion 31 of the urging block 30.

The outer housing 20 is further provided in the bottom 28 with a plurality of retaining cavities 27. The locating plate 50 is provided in the upper side with a plurality of retaining pillars 52 corresponding in location to the retaining cavities 27 of the outer housing 20. The outer housing 20 is further located securely by the locating plate 50 such that the retaining pillars 52 of the locating plate 50 are retained in the retaining cavities 27 of the outer housing 20.

The elastic body 40 may be a spring. Accordingly, the locating plate 50 is provided in the upper side with a locating projection 53 for locating the spring 40.

Figure 8:
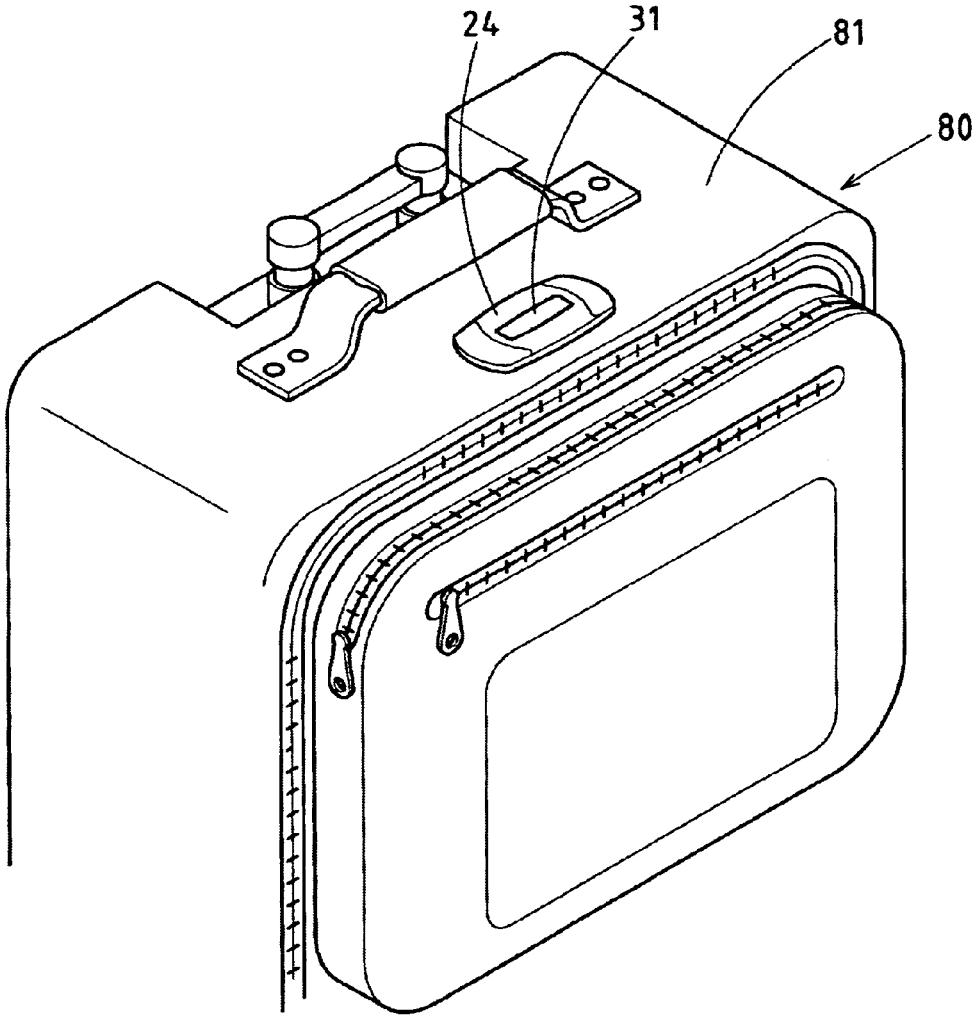
FIG. 8 shows a perspective view of the luggage as shown in FIG. 7, with the external strap being removed from the luggage.
Figure 9:
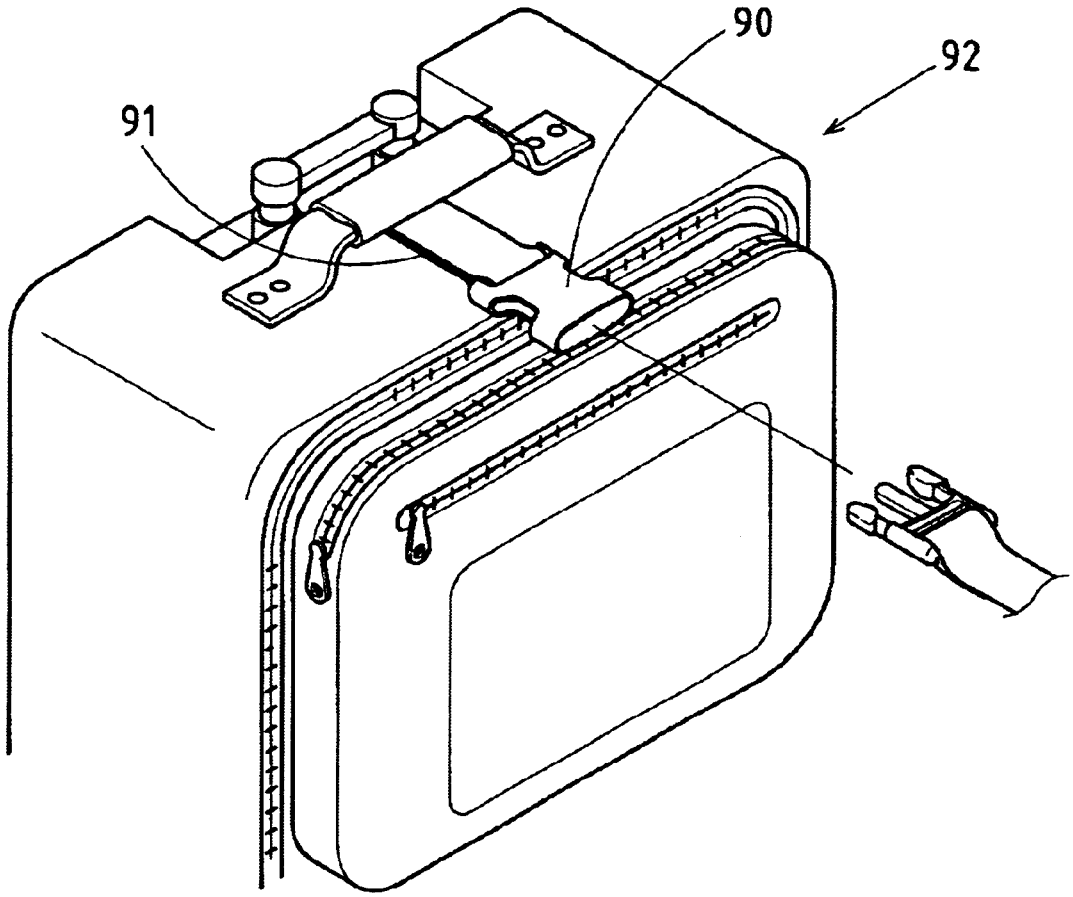
FIG.9 PRIOR ART
FIG. 9 shows a perspective view of a prior art luggage with a buckling device.

As shown in FIG. 8, the present invention is free of the deficiencies of the prior art buckling device 90 as shown in FIG. 9. The top 24 of the outer housing 20 of the present invention is almost level with the external side of the shell 81 of the luggage 80. In the meantime, the through slot 25 of the outer housing 20 of the present invention is sealed off by the protrusion 31 of the urging block 30. The advantages of the present invention over the prior art device are therefore readily apparent.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A strap buckling assembly of a luggage for use in holding an attachment to the exterior of the luggage by the strap, said strap buckling assembly comprising:

an outer housing which is fastened to an external side of a shell of the luggage and is comprised of, in an interior, a cell, said outer housing further comprised of, in a top, a through slot in communication with said cell, and in a bottom, an opening in communication with said cell;

an inner housing which is fastened to an internal side of the shell of the luggage such that said inner housing is corresponding in location to said outer housing, said inner housing comprised of an open slot facing said cell of said outer housing;

a locating plate disposed in said open slot of said inner housing for locating the bottom of said outer housing in said open slot of said inner housing;

an urging block comprised of, in an upper side, a protrusion corresponding in form to said through slot of said outer housing, said urging block being movably disposed in said cell of said outer housing via said opening of the bottom of said outer housing such that said protrusion of said urging block is corresponding in location to said through slot of said outer housing;

an elastic body disposed between said urging block and said locating plate such that one end of said elastic body urges an underside of said urging block, and such that another end of said elastic body is located on said locating plate; and a male retainer fastened at one end to the strap and comprised of, at another end with an engagement portion of an L-shaped construction and comprising two arms, said engagement portion comprised of a projection of a length and in alignment with one of said two arms of said engagement portion, said engagement portion being releasably retained in said cell of said outer housing via said through slot of said outer housing such that said one arm and said projection of said engagement portion are held securely between said protrusion of said urging block and arresting portions contiguous to an inner end edge of said through slot of said outer housing whereby said engagement portion is released from said outer housing by an external force exerting on said male retainer so as to cause said engagement portion to force said protrusion of said urging block to move away from said one arm and said projection of said engagement portion, thereby enabling said one arm and said projection of said engagement portion of said male retainer to be moved out of said cell of said outer housing.

2. The strap buckling assembly as defined in claim 1, wherein said locating plate is comprised of, in an upper side, a plurality of retaining pillars; wherein said outer housing is comprised of, in the bottom, a plurality of retaining cavities corresponding in location to said retaining pillars of said locating plate whereby said outer housing is located by said locating plate such that said retaining pillars of said locating plate are retained in said retaining cavities of the bottom of said outer housing.

3. The strap buckling assembly as defined in claim 1, wherein said elastic body is a spring; wherein said locating plate is comprised of, in an upper side, a locating projection for locating said spring.

* * * * *